United States Patent [19]

Muller

[11] 3,946,767

[45] Mar. 30, 1976

[54] SHUTTLELESS WEB WEAVING MACHINE

[75] Inventor: Jakob Muller, Frick, Switzerland

[73] Assignee: Patax Trust Reg., Liechtenstein

[22] Filed: May 31, 1974

[21] Appl. No.: 475,185

[30] Foreign Application Priority Data

June 1, 1973 Switzerland ..... 7922/73

[52] U.S. Cl. ..... 139/122 H

[51] Int. Cl.[2] ..... D03D 47/34; D03D 47/36

[58] Field of Search ..... 139/122 R, 122 W, 122 H, 139/123, 124 R, 125, 126, 127 R; 66/84 A, 85 A; 226/109, 113, 114

[56] References Cited

UNITED STATES PATENTS

| | | | |
|---|---|---|---|
| 3,347,283 | 10/1967 | Bartosek et al. | 139/122 |
| 3,411,548 | 11/1968 | Pfarrwaller | 139/122 |
| 3,425,462 | 2/1969 | Pfarrwaller | 139/122 |
| 3,561,499 | 2/1971 | Hortmann | 139/122 |

*Primary Examiner*—James Kee Chi

*Attorney, Agent, or Firm*—McGlew and Tuttle

[57] ABSTRACT

Weft thread storage means for a shuttleless web weaving machine includes weft thread supply means for each weft thread and at least one weft thread storage device. Each storage device comprises at least one pivotably mounted storage lever and control means to control each storage device in timed co-ordination with the operation of weft thread feed means of the machine. The control means comprises rotatable cam means respectively associated with each storage device to pivotably displace, before the start of each weft feed, the storage levers of the respective storage device from a first position to a second position, thereby to withdraw a predetermined length of each weft thread from its respective supply means. The storage levers are latched in their respective second positions to store the predetermined lengths of weft thread. Each weft thread is clamped before withdrawal from the supply means and the clamping means in each storage device is released, together with the lever latching mechanism, by releasing means co-ordinated with the operation of the weft feed means of the machine. On being released, each weft thread is fed from the storage device at substantially constant thread tension by the weft feed means.

1 Claim, 3 Drawing Figures

SHUTTLELESS WEB WEAVING MACHINE

BACKGROUND OF THE INVENTION

The present invention relates to a shuttleless web weaving machine.

In shuttleless web weaving machines, the weft thread is fed into the weave during each weaving step by weft thread input means, while the required weft thread must be withdrawn from a weft thread reel. When the weft input feed begins after the formation of the weave, this has the consequence of a tensile loading of the weft thread, which starts suddenly and lasts up to the end of the input feed. In known shuttleless web weaving machines, this uneven tensile loading has the consequence, at high weaving speeds, of the formation of curls or the tearing of the weft thread and thereby leads to a limitation of the weaving speed. However, even at slow weaving speeds, the jerky withdrawal of the weft thread has the consequence of an uneven thread tension and thereby a worsening of the quality of the woven product.

Shuttleless broad web machines are also known, in which the weft thread is fed into the weave of a gripper or is blown in by a jet. In these machines between the weft thread reel and the weft thread input feed means, there is arranged a storage drum, on which a few turns of weft thread are wound before each input. During the input, this can be withdrawn from the drum. In such broad web machines; in contrast to other web weaving machines in which the weft thread carries on without break; the weft thread is cut off at each feed of the weft thread in the broad web machines. Therefore, an exact dimensioning of the thread section to be stored is not necessary in broad web machines.

SUMMARY OF THE INVENTION

According to the invention there is provided weft thread storage means for a shuttleless web weaving machine, the storage means comprising at least one weft thread supply means, at least one storage device comprising at least one pivotably mounted weft thread storage lever, and control means comprising rotatable cam means respectively associated with each storage device to actuate each storage lever thereof, the arrangement being such that, before each weft is fed to such machine, a length of weft thread corresponding to that to be inserted in the web is withdrawn from the corresponding supply means by actuation of the lever of the respective storage device, is stored in the respective storage device, and is released from the respective storage device in co-ordination with the operation of the weft feed means of such machine in such a manner that a substantially constant weft thread tension results.

Preferably, each storage device is provided with at least one stationary thread guide, either one or two movable thread storage levers, a thread clamping device and at least one thread tensioner device. The effective length of each thread storage lever is preferably adjustable so that the length of the thread section to be stored can be matched to the breadth of the woven product. The thread tensioner device has the effect, that the weft thread displays an approximately constant tension during the input feed as well as in the intermediate periods, in which the thread clamping device is closed.

Expediently, the storage means is provided with several storage devices for differently colored weft threads and the control system is provided with a rotatable axle provided with cam plates, a lever system and with a latch for each thread storage lever. These elements are so arranged that, during each weft thread input feed, the thread clamping device in a selected one of the thread storage devices may be released and the thread storage lever of the selected storage device may be unlatched. The thread storage levers associated with other than the selected storage device remain blocked, during that time, in the position in which the weft thread is stored.

The individual thread storage devices may be so constructed that several weft threads can be guided through each of them. This makes it possible to weave several webs simultaneously on one weaving machine.

BRIEF DESCRIPTION OF THE DRAWINGS

An embodiment of the invention will now be more particularly described with reference to the accompanying drawings, in which.

DESCRIPTION OF THE PREFERRED EMBODIMENT

Figure 2:
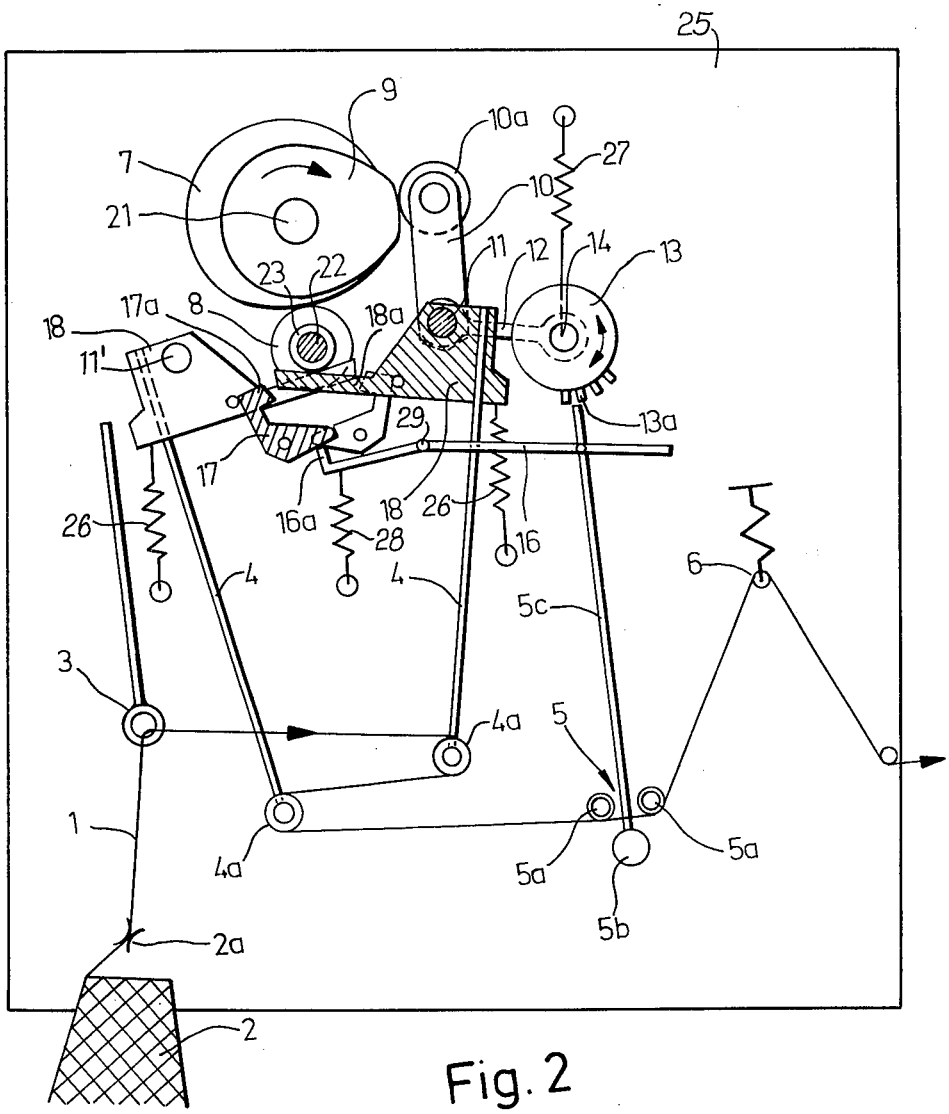
FIG. 2 shows the same elements as are shown in FIG. 1, however in the position during the feed of the weft thread.
Figure 3:
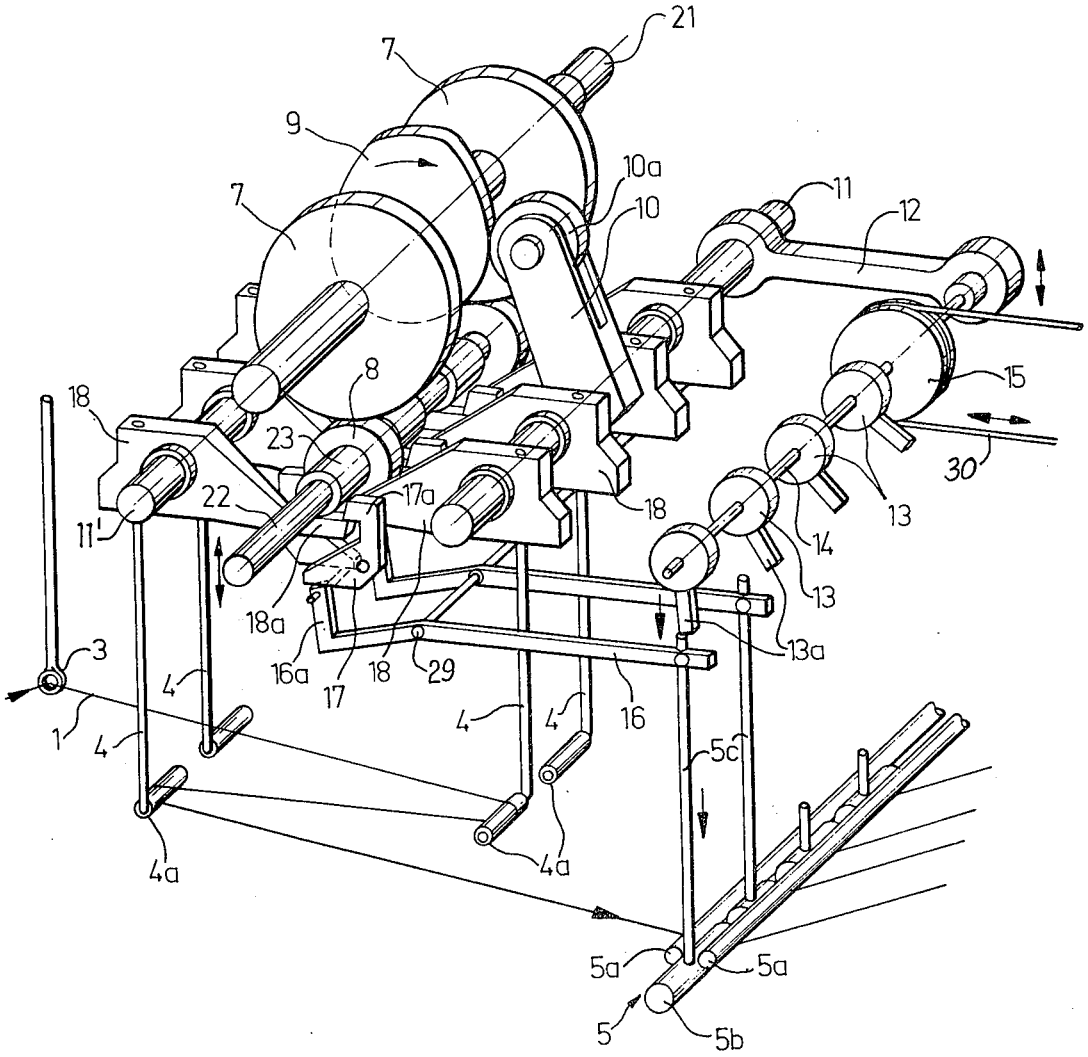
FIG. 3 shows a perspective view of the storage means including a plurality of storage devices.

The shown weft thead storage means is provided for a web weaving machine, by which up to 20 webs, each with four differently colored weft threads, can be woven simultaneously. For this, not all webs need of course display the same color composition. The sole condition is that those portions of the pattern, which have the same colored in the first web must likewise be uniformly colored in each following web. For this, the storage means must be provided with four storage devices, through which twenty weft threads can be guided each time. To obtain an easily viewable representation, a storage means with, in each case, only one of the total of four storage devices is however shown in FIGS. 1 and 2. FIG. 3 shows a perspective view of the storage means mounted in a suitable support frame schematically illustrated at 25 . In particular, in FIG. 3, only one of the eighty thread guides and only one weft thread is shown to be continuous, and the thread reels and the thread tensioners have been entirely omitted.

A weft thread 1 is withdrawn through a thread brake 2*a* from each of the eighty stationary weft thread supply means in the form of reels 2 and supplied to one of the four storage devices, each reel 2 and its associated thread brake 2*a* constituting a weft feed means.

Each storage device has a stationary thread guide 3 for each thread reel 2. Furthermore, each storage device includes two movable thread storage levers 4, at the ends of which are journalled respective rollers 4*a*, a thread clamping device 5 and a respective thread tensioner 6 for each thread. The rollers 4*a* are provided with 20 annular grooves (not shown), which serve for the guidance of the 20 weft threads.

Each thread storage lever 4 is releasably attached to a respective pivoted lever carrier 18 in such a manner, that its length can be adjusted and matched to the breadth of the woven product. Each thread clamping device 5 includes a clamping piece 5*b* and an actuating rod 5*c*. Furthermore, two common clamping seats 5*a* are present for all clamping devices. These elements are so formed that the twenty weft threads can be clamped fast between the clamping piece 5*b* and the clamping seats 5*a*.

The control system is provided with a drive shaft 21, on which two storage cam discs 7 are attached, and with an intermediate shaft 22, which is displaceable radially of the drive shaft 21 and on which two rollers 8 and one hollow cylinder 23 for each storage device are arranged. The circumferential surfaces of the storage cam discs 7 and the rollers 8 touch each other, so that the rotation of the drive shaft 21 effects a periodic up and down movement of the rollers 8 and of the hollow cylinders 23 connected therewith. Each lever carrier 18 has an arm-shaped prolongation 18*a* engageable with the hollow cylinder or sleeve 23. By virtue of suitable means, such as tension springs 26 connected to lever carriers 18, the prolongations 18 *a* are biased upwardly to engage holloe cylinder 23 and, through shaft 22, thus maintain rollers 8 in engagement with cam discs 7. The up and down movement of hollow cylinders 23, mentioned above, oscillates lever carriers 18, when unlatched, so as to correspondingly swing storage levers 4 toward and away from each other.

Attached to the drive shaft 21 of the control system is a further cam disc 9, which serves to actuate the thread clamping devices 5. Through the swivel arm 10 provided with a feeler roller 10*a* , cam disc 9 effects oscillation of the shaft 11, which in its turn is connected to be rotationally secured with the swivel arm 12. A shaft 14, on which a roller respective and cam plates 13, each having a cam 13a, for each storage device are attached, is journalled at the outer end of the swivel arm 12. A tension spring 27 connected to shaft 14 biases shaft 11 counterclockwise and thus maintains feeler roller 10*a* engaged with cam disc 9. the different cam plates 13 are offset angularly relative to one another. By angular displacement of the shaft 14 through the roller 15 as operated by rope 3d, the cam plates 13 can be brought into a position in which one of the cams 13*a* comes into coincidence with the end surface of the actuating rod 5c of one thread clamping device 5. A respective latching lever 16 is also articulated to each of these actuating rods 5*c*, and is pivoted intermediate its ends on a pivot 29. Attached at the bent-over end piece 16a of each lever 16 is a pin 31, by which the L-shaped latching members 17 can be actuated. Tension springs 28 bias latching lever 16 counter clockwise. The latching members 17 are provided with nose-shaped projections 17*a* , which engage the arm shaped prolongations 18*a* of the lever carriers 18, whereby the latter can be latched.

Figure 1:
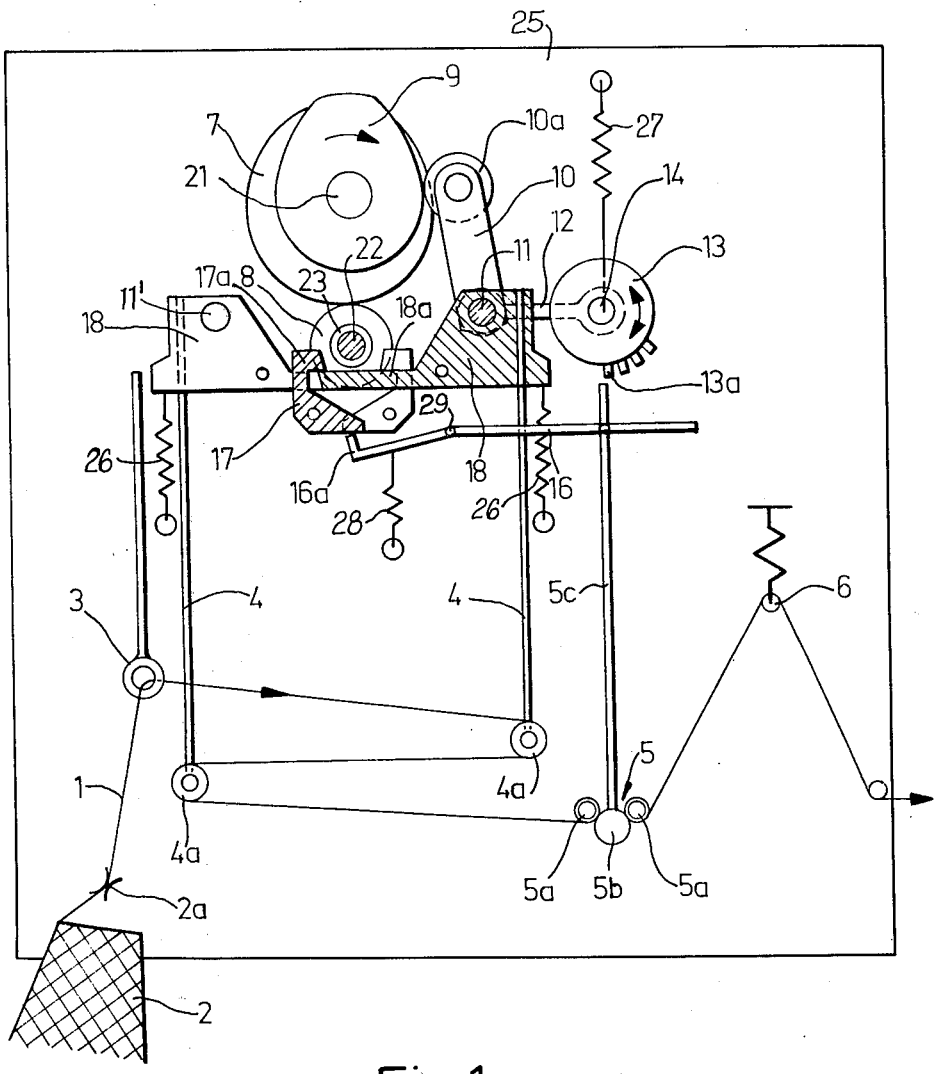
FIG. 1 shows a schematic elevation of a weft thread storage means including a storage device provided with latched storage levers.

The entire control system is assembled in such a manner that the thread storage levers 4 are latched and the thread clamping devices 5 firmly clamp the weft threads for as long as none of the actuating rods 5*c* of the thread clamping devices 5 are pressed downwardly. This state is shown in FIGS. 1 and 3.

If now the twenty weft threads guided through a certain weft thread storage means are to be introduced, the shaft 14 is so angularly displaced by a control pull applied by rope 30 to roller 15, that the end surface of the actuating rods of the corresponding thread clamping device comes into coincidence with the cam 13*a* of the corresponding cam plate. On rotation of the drive axle 21, as shown in FIG. 2, the cam disc 9 urges the swivel arm 10 away from the drive shaft 21. This movement is transferred by the shaft 11 and the swivel arm 12 to the shaft 14 with the cam plates 13. The actuating rod 5*c* of the thread clamping device 5 is thereby pressed downwardly and the thread clamping device concerned is released. Simultaneously, the latching pieces 17 are actuated, and the lever carriers 18 are unlatched, through the resultant clockwise motion of the associated lever 16. The lever carriers 18 can now follow the upward movement of the hollow cylinders 23 arranged on the intermediate axle 22 controlled by the storage cam discs 7 through the rollers 8. In this, the rollers 4*a* journalled on the thread storage levers 4 are brought closer to one another, so that the weft thread sections stored in this storage device are delivered and fed to the weft input means. The chronological course of the delivery is determined by the control cams of the storage cam discs 7. These are so structured that, at each point in time just so much thread is delivered as is required by the introduction process, wherein small deviations are absorbed by the thread tensioners 6. Thereby, a uniform thread tension is attained and a good quality of the woven product assured.

When the drive shaft 21 rotates further, the thread clamping device 5 is again closed and the spacing between the rollers 4*a* enlarges, while new thread sections are withdrawn from the weft thread reels 2. When the maximum spacing between the rollers 4*a* is reached, the thread storage levers 4 are again latched and the storage mechanism is ready to deliver in a further cycle.

The exemplary embodiment explained herein serves for the weaving of twenty webs each with four differently colored weft threads. Other embodiments are of course also possible, such as a storage mechanism for the weaving of twelve or even of twenty-four or more webs each with several, for example eight, differently colored weft threads.

In another embodiment of the invention, each storage device is provided with only one thread storage lever 4. Thereby, the construction of the device may be simplified.

In the described embodiment, the transmission of the movements and the control of the course of movement ensued by purely mechanical elements. It would however also be possible to employ electro-magnetically or pneumatically actuatable elements for certain functions. This concerns particularly the latching and the thread clamping devices, that is to say the elements by which the color of the weft thread section to be delivered is determined.

I claim:

1. In a shuttleless web weaving machine provided with weft thread feed means to feed periodically a predetermined length of at least one weft thread to web weaving means included in said machine, weft thread storage means comprising, in combination, a frame; said weft thread feed means including at least one weft thread supply means and an associated thread brake mounted on said frame; at least one weft thread storage device, each comprising at least one thread storage lever pivotably mounted on said frame and engaged with a weft thread drawn from said weft thread supply means through said thread brake; and control means operable to control each storage device in timed coordination with the operation of said weft thread feed means; said control means including cam means rotatably mounted on said frame and respectively associated with each storage device to pivotably displace, before the commencement of each weft thread feed, each storage lever of the respective storage device from a first position to a second position, thereby to withdraw said predetermined lengths of weft thread from the associated supply means through the associated thread brake, and to effect storage of said predetermined length of weft thread in the associated storage device, and means operable to release each stored weft thread at the commencement of each weft thread feed to provide for said weft thread feed means to feed the stored length of weft thread from the associated storage device at a substantially constant tension; respective tensioning means engageable with each weft thread delivered from a storage means; a respective thread clamping device operatively engaged with the weft thread between the associated tensioning means and the last storage lever of the associated storage device; the effective length of each thread storage lever being presettable to enable the length of thread stored in the respective storage device to be predetermined in accordance with the breadth of the web to be woven by said machine; said storage means comprising at least two storage devices; a shaft rotatably mounted in said frame; at least two cam members mounted on said shaft to be rotatable therewith; a respective latching mechanism to latch each storage lever of each storage device; and a respective linkage system operable to couple each latching mechanism and the associated clamping device to a respective one of said cam members; whereby, for each weft feed operation, the respective thread clamping device and the respective latching mechanism in only one of said storage devices is releasable.

* * * * *